US012644362B2

(12) United States Patent
MacGillivray et al.

(10) Patent No.: US 12,644,362 B2
(45) Date of Patent: Jun. 2, 2026

(54) FULLY AUTOMATED PERFORATING GUN

(71) Applicant: Halliburton Energy Services, Inc., Houston, TX (US)

(72) Inventors: Joseph Todd MacGillivray, Alvarado, TX (US); Christopher C. Hoelscher, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/363,501

(22) Filed: Aug. 1, 2023

(65) Prior Publication Data

US 2025/0043667 A1 Feb. 6, 2025

(51) Int. Cl.
*E21B 43/1185* (2006.01)
*E21B 17/042* (2006.01)
*E21B 43/119* (2006.01)

(52) U.S. Cl.
CPC .... *E21B 43/11855* (2013.01); *E21B 17/0426* (2013.01); *E21B 43/119* (2013.01)

(58) Field of Classification Search
CPC .. E21B 43/1185; E21B 43/116; E21B 43/119; E21B 17/0426
See application file for complete search history.

(56) References Cited

U.S. PATENT DOCUMENTS

| | | | |
|---|---|---|---|
| 9,677,363 | B2 | 6/2017 | Schacherer et al. |
| 10,077,641 | B2 | 9/2018 | Rogman et al. |
| 11,098,562 | B2 | 8/2021 | Box et al. |
| 11,359,468 | B2 | 6/2022 | Roberts et al. |
| 11,460,281 | B2 | 10/2022 | Leclair et al. |
| 2011/0024116 | A1 | 2/2011 | Mccann et al. |
| 2013/0133889 | A1* | 5/2013 | Schacherer ..... E21B 29/02 166/55 |
| 2021/0079767 | A1* | 3/2021 | Box ..... E21B 43/119 |
| 2021/0372744 | A1 | 12/2021 | Macgilllivray et al. |
| 2022/0145732 | A1* | 5/2022 | Anthony ..... E21B 43/119 |
| 2022/0235634 | A1* | 7/2022 | Lagrange ..... F42B 3/26 |
| 2022/0333467 | A1 | 10/2022 | Eitschberger et al. |
| 2023/0228174 | A1* | 7/2023 | Davis ..... E21B 23/04 166/297 |

FOREIGN PATENT DOCUMENTS

WO 2020050861 3/2020

OTHER PUBLICATIONS

"PCT Application No. PCT/US2023/071556, International Search Report and Written Opinion", Apr. 17, 2024, 10 pages.

* cited by examiner

*Primary Examiner* — Caroline N Butcher
(74) *Attorney, Agent, or Firm* — DeLizio, Peacock, Lewin & Guerra LLP

(57) ABSTRACT

Some implementations include a perforating gun configured for transport with an internal detonator, the perforating gun to be used in a wellbore proximate to one or more subsurface formations, the perforating gun comprising: a detonator assembly positioned proximate to a ballistic initiator end of the perforating gun, wherein the detonator assembly includes the detonator; and a detonation cord positioned proximate to a receiver end of the perforating gun, wherein the ballistic initiator end is on an opposing side of the perforating gun from the receiver end; and an isolation cask disposed at the ballistic initiator end of the perforating gun, wherein the detonator assembly is recessed within the isolation cask.

18 Claims, 9 Drawing Sheets

FULLY AUTOMATED PERFORATING GUN

BACKGROUND

Perforating or "frac" guns may be utilized in oil and gas completions and related operations to propel projectiles into one or more subsurface formations, thus creating initial fractures which may be propagated during hydraulic fracturing. Typical select fire (or "plug-n-play") style perforating guns may require that an internal detonator be shipped separate from the rest of the perforating gun. Rules such as the American Petroleum Institute's Recommended Practice 67 (API RP 67) are in place to avoid unintentional detonation of explosives during shipping and at well sites. In compliance with this rule, perforating guns may include a detonator interrupt barrier installed between the detonator and the gun detonation train. API RP 67 requires that the perforating gun is unarmed (detonator is not coupled to the detonating cord), so that if a detonator is unintentionally initiated, the charges will not detonate. These detonation interrupt barriers, while improving safety, have induced inefficiencies in tool construction. For example, perforating guns with detonation interrupt barriers may include additional components in the tool string, contribute to additional costs, may necessitate additional failure modes, and may require additional human action to remove or deactivate the barrier at the well site.

BRIEF DESCRIPTION OF THE DRAWINGS

Implementations of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. In other instances, well-known instruction instances, protocols, structures, and techniques have been omitted for clarity.

To overcome inefficiencies induced by the detonator interrupt barrier, a perforating gun may include a detonator configured in an unarmed state until the gun is connected to another perforating gun. The detonator may be shipped inside of the gun in an unarmed position with the detonator isolated from the detonating cord, preventing an accidental detonation from initiating charges within the perforating gun. To accomplish this, the detonator may be placed in an isolation bulkhead of the perforating gun. Only when the perforating gun is threaded together with another perforating gun does a detonator assembly become ballistically armed.

Example Automated Perforating Gun

Figure 1:
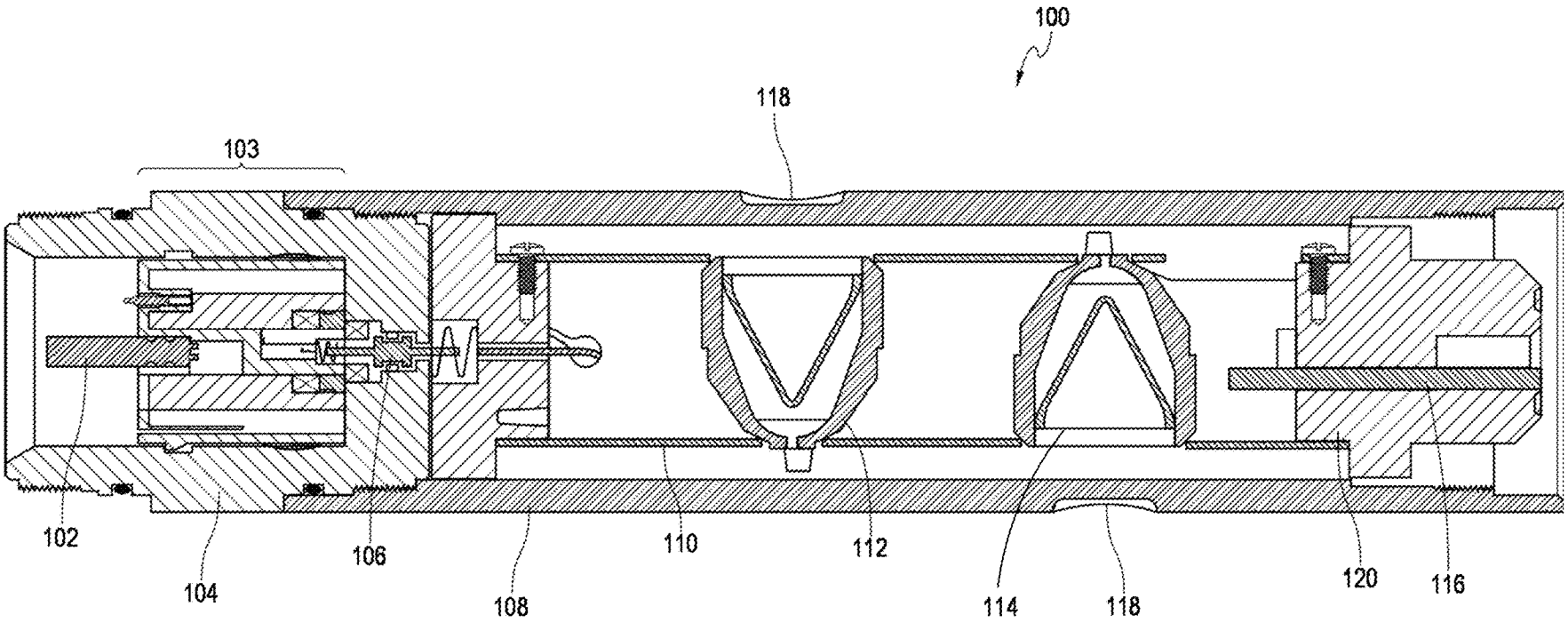
FIG. 1 is an illustration depicting an example automated perforating gun, according to some implementations.

An example automated perforating gun system is now described. FIG. 1 is an illustration depicting an example automated perforating gun 100, according to some implementations. The automated perforating gun 100 (also referred to as the "gun 100") may include a gun carrier 108 configured to house a plurality of components including a detonator 102, a detonator assembly 103, an isolation cask 104, a feedthrough 106, a charge tube assembly 110, charge segments 112, 114, and a detonation cord 116. The gun carrier 108, also referred to as a gun body, may be configured to house the charge tube assembly 110, the charge segments 112, 114, and various electrical connections (via wires, integrated electrical contacts, etc.) The charge tube assembly 110 may include end alignments on either end to maintain an alignment of the charge segments 112, 114 with one or more scalloped regions 118 in the gun carrier 108 through which charges are to be fired. The charge tube assembly 110 may further include a wire for pass-through transmission and at least part of the detonation cord. In some implementations, the charge tube assembly 110 may be comprised of metal or a metal alloy such as steel. In other implementations, the charge tube assembly 110 may be comprised of plastics including, but not limited to polyetheretherketone (PEEK), Nylon, polylactic acid (PLA), polycarbonate (PC), polyamide (PA), and other electrically-insulated plastics.

Each charge segment 112, 114 may be configured to carry a shaped charge. For example, the shaped charge may be loaded either by on-site personnel or an automated device into the charge segments. The charge segments 112-114 may comprise an internal conical liner as part of the shaped charge. The liner may be in contact with one or more explosive powders (primer, a secondary explosive, etc.), and a casing to house the explosive components. In some implementations, the detonation cord 116 may extend through the rear of the charge segments 112, 114. The charge segments 112, 114 may comprise a molded plastic housing comprised of an electrically-insulated molded plastic. For example, the charge segments 112, 114 may be comprised of materials including, but not limited to polyetheretherketone (PEEK), Nylon, polylactic acid (PLA), polycarbonate (PC), polyamide (PA), and other electrically-insulated plastics. In some implementations, the charge segments 112, 114 may be comprised of steel.

In some implementations, the automated perforating gun 100 may be an oriented gun system. For example, a space between the charge tube assembly 110 and the gun carrier 108 may include ball bearings that enable the charge tube assembly 110 and the charge segments 112, 114 to rotate within the gun carrier 108. In some implementations, the one or more scalloped regions 118 may also be configured to radially move and align with the charge segments 112, 114. In other implementations, the gun carrier 108 may include stationary, scalloped bands positioned around a rotational axis of the charge segments 112, 114. The end alignment 120 may include a detonating cord receptacle configured to allow axial rotation while maintaining a ballistic connection between the detonation cord 116 and the detonator of a second perforating gun.

The isolation cask 104 and feedthrough 106 may be configured to maintain a pressure barrier between the automated perforating gun 100 and a second perforating gun (coupled with the isolation cask 104). The feedthrough 106 may also be configured to allow a pass-through signal from the wireline while maintaining the pressure barrier between the guns. In some implementations, the isolation cask 104 may be configured to shield the detonator from external signal interference that may induce accidental detonation. In some implementations, the isolation cask may be formed or coated with a radio frequency (RF) safe material compliant with API RP 67. Such electrostatic discharging (ESD) materials may include, for example Indium Tin Oxide (ITO), polyester, copper mesh fabric and other RF-blocking films, foils, paints, etc. Other implementations of the isolation cask 104 may utilize a conductor or conductor mesh to form a Faraday cage around the detonator assembly 103. In other implementations, the isolation cask 104 may be configured to shield the detonator from electromagnetic pulses, other external signals, voltages, currents, etc. In some implementations, the isolation cask 104 may include connecting features such as exterior threads. The exterior threads may be configured to form a threaded connection with a second perforating gun.

The detonator assembly 103 may comprise features for receiving an electrical signal from wireline by which the automated perforating gun 100 is conveyed into a wellbore. The detonator assembly 103 may also include features to pass-through electrical signal from the wireline, a grounding element, a retention feature (to retain its position within the gun carrier 108), and electronics configured for selective firing of the detonator 102.

In some implementations, rather than using wires to connect gun components, the automated perforating gun 100 may instead use integrated electrical contacts and electrical conductors disposed around the charge segments 112, 114 to carry power throughout the automated perforating gun 100. The charge segments 112, 114 may each comprise an electrical conductor disposed around or within the charge segments 112, 114. In some implementations, the electrical conductor may be configured to wrap around an exterior of each of the charge segments 112, 114. In other implementations, the electrical conductor(s) may be positioned internally within the charge segments but outside ballistic/explosive components in the interior of the charge segments. In some implementations, the isolation cask 104 may include integrated electrical contacts configured to provide continuity for grounding, power, and communication to and from the detonator assembly 103 and the rest of the tool string.

Each electrical conductor may comprise features to lock adjacent charge segments together and to maintain the electrical connection across various components. For example, the charge segments 112, 114 may comprise integrated contacts at including a male connection on one side and a female connection on the other end. In some implementations, the male and female connections of the electrical conductor(s) may comprise a pin and socket style of electrical connection. Integrated contacts within at least the detonator assembly 103, the feedthrough 106, the charge segments 112, 114, and the end alignment 120 may allow power to be transferred through the automated perforating gun 100 without the use of wires (to, for example, a second perforating gun).

The detonator assembly 103 may include the detonator 102. The detonator assembly 103 and detonator 102 may be housed (recessed) within the isolation cask 104 at a ballistic initiation end of the gun 100. At an opposite end of the gun 100, the receiver end, is the detonation cord 116. Traditional gun systems may require a barrier or similar system to be placed between the detonator assembly 103 and the detonation cord 116 to achieve an unarmed position during shipping. This barrier must be removed prior to firing, either by field personnel upon gun string assembly (comprising multiple perforating guns similar to the gun 100) or via an electrical signal downhole.

In contrast, the fully automated perforating gun 100 requires no such barrier. The gun 100 becomes ballistically armed when forming a threaded connection with a second perforating gun. To become "ballistically armed" may refer to positioning a detonator in such a manner that allows an initiation of the next explosive component of an explosive train. In some implementations, this may entail coupling the detonator of a perforating gun to the detonation cord 116 of the automated perforating gun 100—in this configuration, the gun 100 is ballistically armed by a proximate perforating gun in the explosive train. Ballistically arming perforating guns only when they form a threaded connection with a second perforating gun permits the perforating gun 100 to be shipped with an intact detonator while still abiding by API RP 67. This technique may also lessen an amount of necessary human interaction with the perforating gun 100 prior to conveying the gun 100 downhole. Thus, the gun 100 provides an autonomous detonation interruption safety system for perforating guns and detonators that may eliminate the need for additional personnel, extra operations prior to conveyance into the wellbore, administrative controls, and additional components in a perforating work string.

By shipping the detonator 102 pre-installed within the automated perforating gun 100, the gun 100 may undergo a full system inspection prior to leaving its manufacturing facility, reducing the number of steps to be completed by field personnel. Shipping the detonator pre-installed within the gun 100 also eliminates costs related to shipping and storing detonators and perforating guns separately. The configuration of the detonator 102, detonator assembly 103, and the detonation cord 116 in the gun 100 also eliminates the need for an interrupt device positioned between the detonation cord and detonator used in traditional perforating gun systems. The interrupt devices may be accompanied by other internally movable components and are typically removed via mechanical means, by electrical actuation, or by human personnel on-site, similar to the barrier(s) discussed above. Thus, the exclusion of interrupt devices from the automated perforating gun 100 may further reduce costs and complexity of the automated perforating gun 100 (thus enhancing its reliability).

Figure 2A:
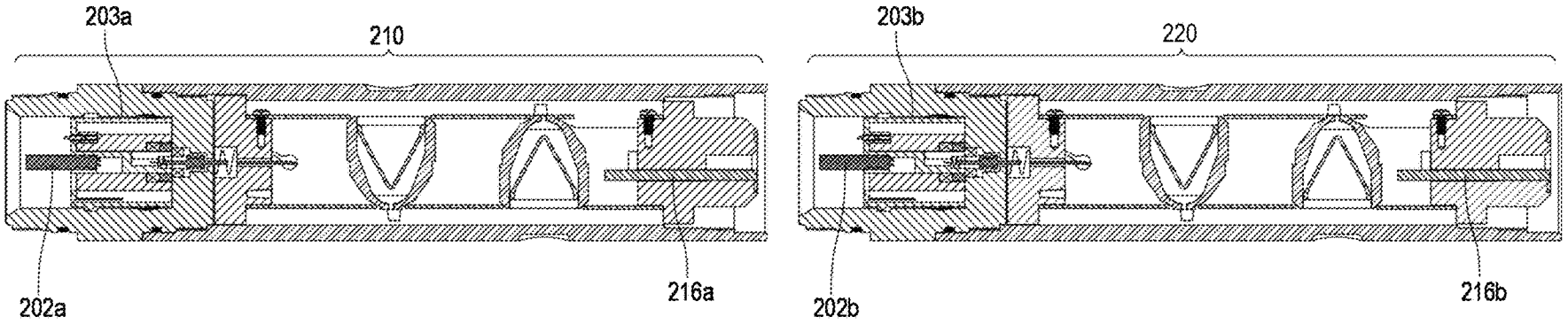
FIG. 2A is an illustration depicting two automated perforating guns positioned for coupling, according to some implementations.

FIG. 2A is an illustration depicting two automated perforating guns positioned for coupling, according to some implementations. A first automated perforating gun 210 may be configured to couple with a second perforating gun 220. The first perforating gun 210 may include a detonator 202A, a detonator assembly 203A, and a detonation cord 216A. The second perforating gun 220 may include a detonator 202B, a detonator assembly 203B, and a detonation cord 216B. As depicted, the detonator 202B may be positioned for side-to-side initiation with the detonation cord 216A. In some implementations, the detonator 202B and detonation cord 216A may be configured for end-to-end initiation, where a face of the detonator 202B couples to a face of the detonation cord 216A. The end of the first perforating gun 210 comprising the detonation cord 216A may be referred to as the receiver end, and the end of the second perforating gun 220 comprising the detonator 202B may be referred to as the ballistic initiator end.

Figure 2B:
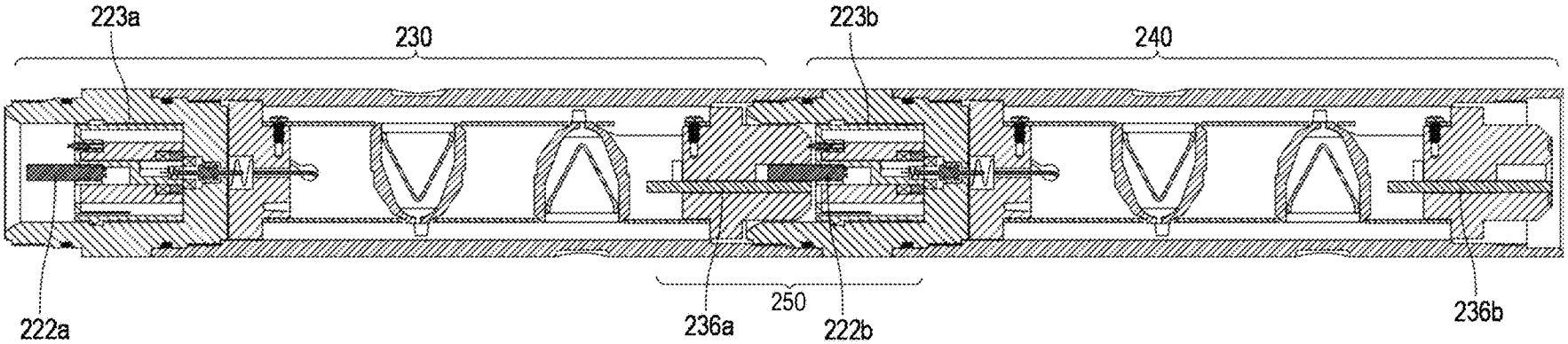
FIG. 2B is an illustration depicting a coupling of two automated perforating guns, according to some implementations.

FIG. 2B is an illustration depicting a coupling of two automated perforating guns, according to some implementations. A first perforating gun 230 may be similar to the perforating gun 210 and may comprise a detonator 222A, a detonator assembly 223A, and a detonation cord 236A. A second perforating gun 240 may be similar to the perforating gun 220 and may comprise a detonator 222B, a detonator assembly 223B, and a detonation cord 236B. In FIG. 2B, the detonation cord 236A is coupled to the detonator 222B in a side-to-side configuration to form an armed connection 250. In some implementations, the first perforating gun 230 may form a threaded connection with the second perforating gun 240. Once the armed connection 250 has been formed by ballistically coupling the detonator 222B to the detonation cord 236A, the first perforating gun 230 may be considered to be armed.

Figure 3:
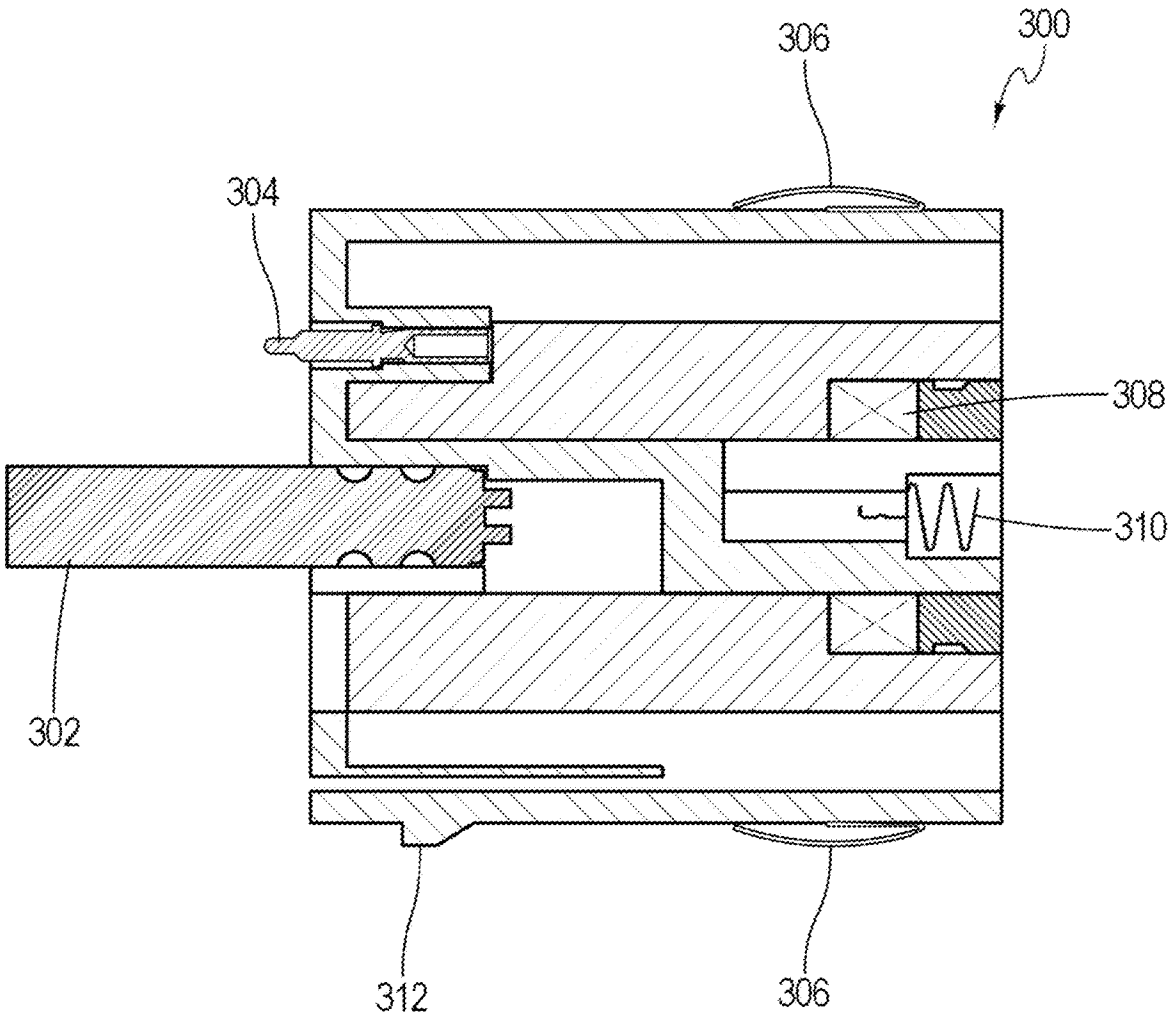
FIG. 3 is an illustration depicting an example detonator assembly, according to some implementations.

FIG. 3 is an illustration depicting an example detonator assembly 300, according to some implementations. The detonator assembly 300 may include a detonator 302, a power input 304, a ground 306, a select fire electronics module 308, a power output 310, and a retention feature 312. The detonator assembly 300 may reside within a perforating gun similar to the automated perforating gun 100 of FIG. 1. In some implementations, the detonator assembly 300 may be removable from the perforating gun. For example, the retention feature 312 may be configured to slot into a groove in the isolation cask 104 of FIG. 1 to allow for easy installation or removal of the detonator assembly 300 from the perforating gun.

The power input 304 may comprise a power pin configured to receive power from an end alignment of a second perforating gun. With reference to FIG. 2B, the detonator assembly 223B may comprise a power input configured to receive power from the first perforating gun 230. The power output 310 may be configured to route the received power to a feedthrough similar to the feedthrough 106 of FIG. 1. The feedthrough may convey the power to the remainder of the perforating gun of which the detonator assembly 300 resides. With regard to power flow through the detonator assembly 300, the ground(s) 306 may include one or more conductors configured to ground the detonator 302 to avoid accidental detonation. In some implementations, the ground 306 may be comprised of a conductor including, but not limited to steel, copper, and brass. In some implementations, power may be transferred to and from the power input 304 and power output 310 via wires. In other implementations, the power may be transferred via integrated electrical contacts.

The select fire electronics module 308 may allow power to be transmitted from the wireline to the detonator 302. In an explosive train comprising multiple perforating guns, each detonator may comprise a unique identifier that may allow for selective firing of specific detonators based on unique signals sent to their respective select fire electronics modules. In some implementations, the select fire electronics module 308 may include a wired connection to the detonator 302. In other implementations, the detonator assembly 300 may include embedded electronics that allow the select fire electronics module 308 to fire the detonator 302 without the use of wires. In some implementations, the detonator assembly 300 may include internal integrated contacts.

In some implementations, the select fire electronics module 308 may include an electronic shunt or a manual shunt. The electronic shunt (also referred to as a digital switch) may prevent power from being supplied to the detonator 302 which, in traditional gun systems, may be vital for shipping. The electronic shunt may be configured to open or close a circuit to the detonator 302 via an electronic signal sent to the select fire electronics module 308. In some implementations, the manual shunt (also referred to as a mechanical shunt) may be an interrupt device or similar barrier disposed along a wire path to the detonator 302 that must be removed by on-site personnel.

Figure 4:
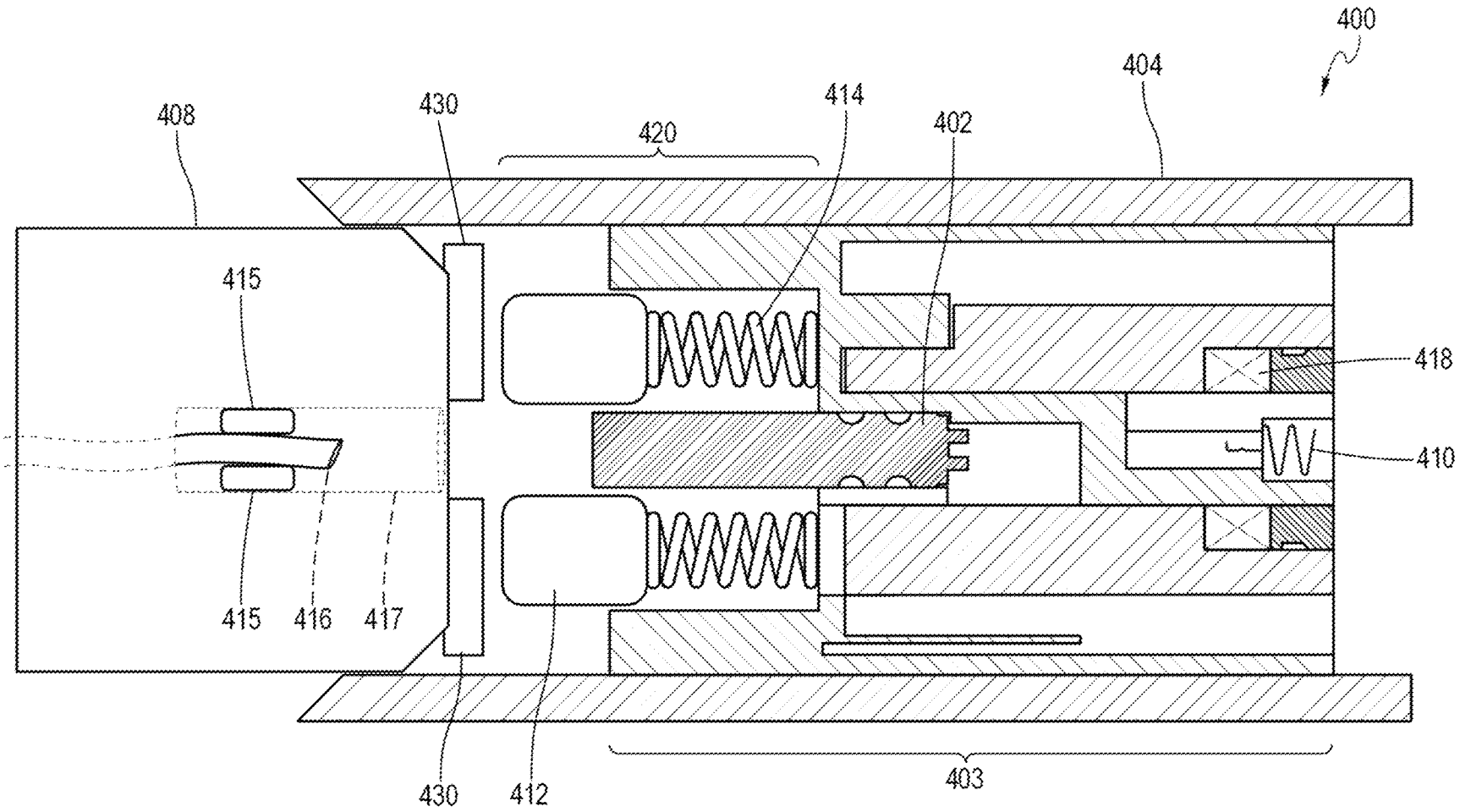
FIG. 4 is a longitudinal section diagram depicting a detonator assembly having alignment features, according to some implementations.

FIG. 4 is a longitudinal section diagram depicting a detonator assembly 403 having alignment features, according to some implementations. The detonator assembly 403 may be housed within an isolation cask 404 and may be configured to have alignment features when coupling a detonator 402 (or fuse, blasting cap, etc.) to a detonation cord 416 within an end alignment 408 of a proximate perforating gun. For example, the detonator assembly 403 may include a spacer assembly 420 comprising one or more springs 414 and one or more compression pads 412. In some implementations, the one or more compression pads 412 may flank the detonator 402 when the detonator 402 couples to the detonation cord 416. In other implementations, the one or more compression pads 412 may include a single, ring-shaped compression pad (i.e., a compression sleeve) with a center opening of substantial diameter to allow the detonator 402 to pass through. The one or more compression pads 412 may protect the detonator 402 from being contacted or damaged by gun components prior to forming a connection with the detonation cord 416 (thus ballistically arming the perforating gun comprising the detonation cord 416). In some implementations, the compression sleeve may be constructed such that it retracts and exposes the detonator 402 when threading with the end alignment 408 of the other perforating gun.

In some implementations, the one or more springs 414 and the one or more compression pads 412 (i.e., the spacer assembly 420) may be comprised of any electrostatically inert material. In some implementations, the one or more springs 414 may be comprised of various types of steel (music wire, stainless steel, other high carbon wires), brass, bronze, rubber, etc., while the one or more compression pads 412 may be comprised of Nylon 12. In some implementations, the one or more compression pads 412 may be comprised of an electrostatically inert material comprising a surface resistivity lower than $10^{13}$ ohms/square, as reducing static electricity near the detonator 402 may reduce the chances of premature detonation.

The one or more compression pads 412 may contact a centralizing shield 430 coupled to the end alignment 408. The centralizing shield 430 may be configured to protect the end alignment 408 in the event of a premature detonation of the detonator 402. The one or more springs 414 may compress upon the compression pad(s) 412 making contact with the centralizing shield 430. As the one or more springs 414 compress, the detonator 402 may be pushed through an opening between the one or more compression pads 412 to contact the detonation cord 416. In some implementations, the one or more springs 414 may help to account for tolerances when forming the connection between the detonator 402 and the detonation cord 416, thus providing additional protection to the detonator 402.

In some implementations, the detonator assembly 403 may comprise a power output 410 similar to the power output 310 of FIG. 3. The detonator assembly 403 may include a select fire electronics module 418 which may be similar to the select fire electronics module 308 of FIG. 3. In some implementations, the select fire electronics module 418 may include a digital switch which may be similar to the electronic shunt of the select fire electronics module 308. In some implementations, the detonator assembly 403 may also include a power pin similar to the power input 304 of FIG. 3, despite not being visible in the longitudinal section.

In some implementations, the end alignment 408 may include a detonation cord retention and alignment receptacle 417 (hereafter referred to as the "detonation cord receptacle 417") positioned at a receiver end of the perforating gun including the end alignment 408. The detonation cord receptacle 417 may include one or more aligning features 415 to maintain an alignment of the detonation cord 416 with the detonator 402 (positioned at the ballistic initiator end of the other perforating gun). The detonator 402 may ballistically arm (connect to) the detonation cord 416 within the detonation cord receptacle 417. The detonation cord receptacle 417 may also include electrical connection features to provide continuity contacts with the mating perforating gun. In some implementations, the detonation cord receptacle 417 may be configured to allow axial rotation of the respective perforating guns while maintaining the connection between the detonation cord 416 and the detonator 402.

Figure 5:
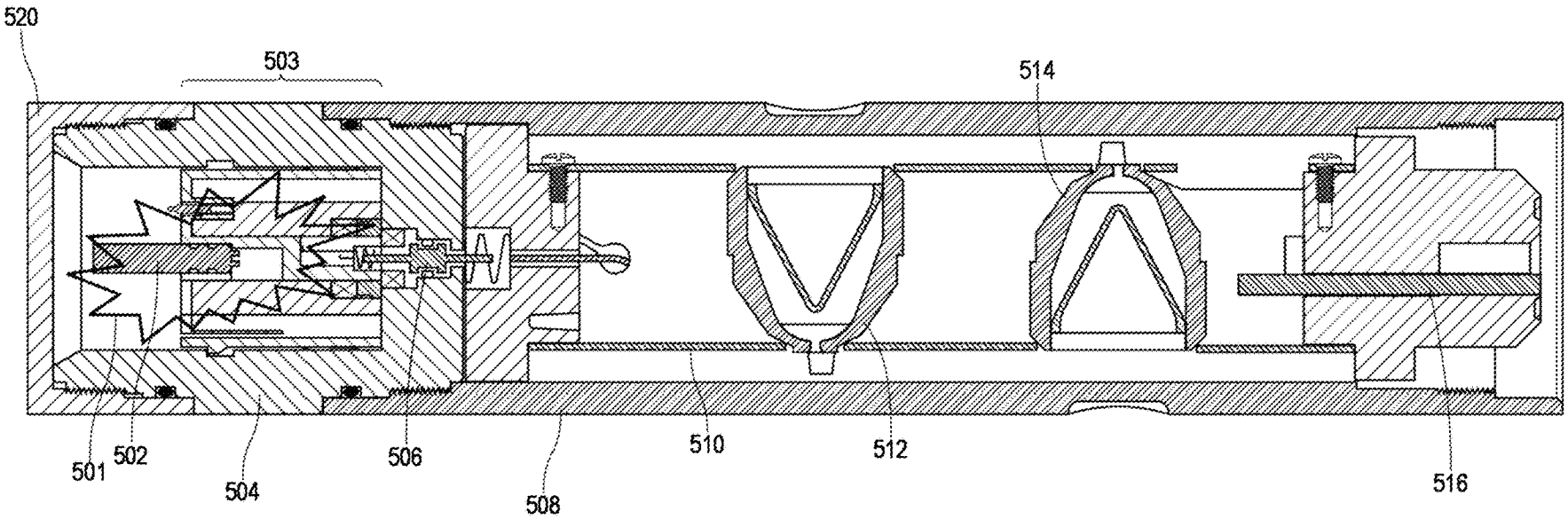
FIG. 5 is an illustration depicting an example automated perforating gun having a shipping cap, according to some implementations.

FIG. 5 is an illustration depicting an example automated perforating gun 500 having a shipping cap 520, according to some implementations. The automated perforating gun 500 may comprise similar components to the automated perforated gun 100 of FIG. 1. For example, the perforating gun 500 may include a detonator assembly 503 having a detonator 502, an isolation cask 504, a feedthrough 506, a gun carrier 508, a charge tube 510, charge segments 512, 514, and a detonation cord 516. As previously discussed, the detonation cord 516 and detonator 502 are ballistically separated to allow the automated perforating gun 500 to be shipped/stored with the detonator 502 intact. However, the detonator 502 may require protection during shipping, and the shipping cap 520 may provide this protection. In some implementations, the shipping cap 520 includes threads and may be twisted onto a set of threads disposed on an exterior of the isolation cask 504, thus forming a threaded connection with the automated perforating gun 500.

The shipping cap 520 may be coupled to the ballistic initiator end of the perforating gun 500 including the detonator 502. In some implementations the shipping cap 520 may be included to isolate the detonator 502 and isolation cask 504 from an outside environment. For example, the shipping cap 520 may protect the detonator 502 from exterior hazards and impurities. However, in some implementations, the shipping cap 520 may protect a second perforating gun (or equipment and personnel in the vicinity) from an accidental detonation 501 of the detonator 502. The shipping cap 520 may also contain fragments ejected by the accidental detonation 501. Should the detonator 502 detonate accidentally (e.g., from a lightning strike, fire, etc.), the explosion of the detonator 502 may be contained within the shipping cap 520 and the isolation cask 504. Therefore, the isolation cask 504 is specifically designed to absorb this release of energy in such a way not to result in a catastrophic separation from the perforating gun. The isolation cask material may have an elastic modulus of $30\times10^6$ psi from $18.5\times10^6$ psi. The shipping cap 520 may provide safe containment of explosives during shipping, storage, and handling of the perforating gun 500. When the perforating gun 500 is deployed in a wellbore and coupled with a second perforating gun, the isolation cask 504 may contain an accidental detonation 501 from damaging the rest of the explosive train (i.e., multiple perforating guns coupled in series). The reaction pressures or forces of an explosion are found to be a function of the explosive mass and the containment of the explosive. For this reason, the isolation cask 504's internal volume is specified such that a free air volume (FAV) is maintained as consideration of the ratio of explosive mass that is intended to be housed inside the internal volume of the isolation cask 504. In some implementations, this explosive mass to FAV ratio may be proportioned up to 10.1 lbs.ft3.

Figure 6:
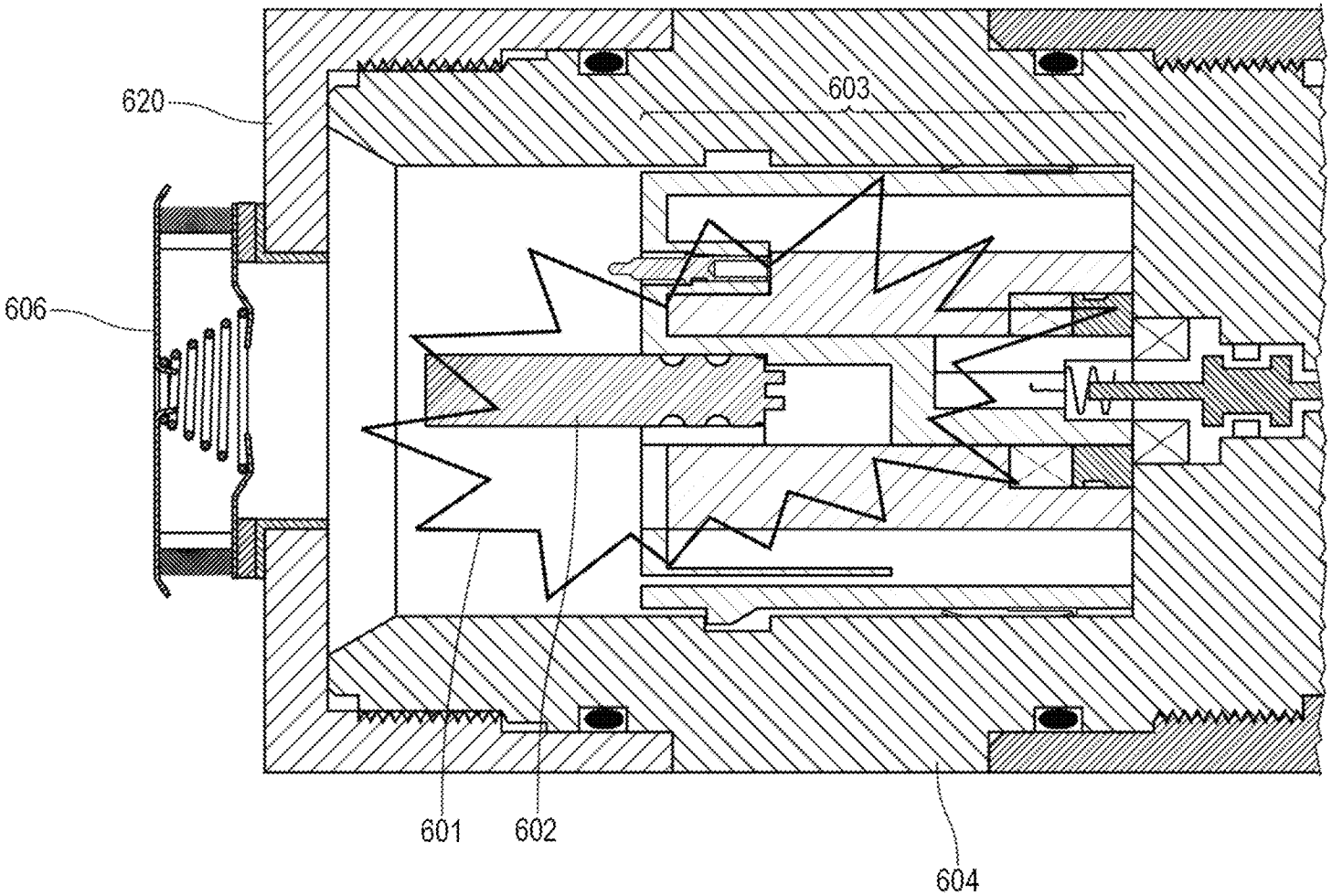
FIG. 6 is an illustration depicting an example shipping cap having a vent plug, according to some implementations.

Some implementations of the shipping cap 520 may include components configured to bleed off excess heat and pressure in the event of an accidental detonation. FIG. 6 is an illustration depicting an example shipping cap having a vent plug, according to some implementations. A shipping cap 620 may be coupled (via a threaded connection) to an isolation cask 604 which houses a detonator assembly 603 of an automated perforating gun. The shipping cap 620 and isolation cask 604 may be configured to contain a hypothetical accidental detonation 601 of the detonator 602. In some implementations, the shipping cap 620 may include a vent plug 606. In some implementations, the vent plug 606 may be an explosion relief valve with a spring. The spring may be compressed via an explosive force of the detonator 602 (explosive force comparable to the detonation of a blasting cap). During the accidental detonation 601, the compressed spring may allow gases to escape from the sides of the vent plug 606. In other implementations, the vent plug 606 may include one or more ports configured to open upon exceeding either a heat threshold or a pressure threshold within the isolation cask 604. The heat and pressure thresholds may be set during assembly of the vent plug 606 based on material thicknesses, melting temperatures, strengths, hardness, elasticities, and other material properties. The vent plug 606 may be formed from one or more plastics or polymers such that pressure and heat above specified thresholds may deform, melt, or otherwise open the one or more ports. For example, during an accidental detonation 601, exceeding either the heat threshold or pressure threshold in the isolation cask 604 may activate the one or more ports disposed on the vent plug 606. Excess pressure and heat within the isolation cask 604 may bleed out through the one or more ports once activated.

Figure 7:
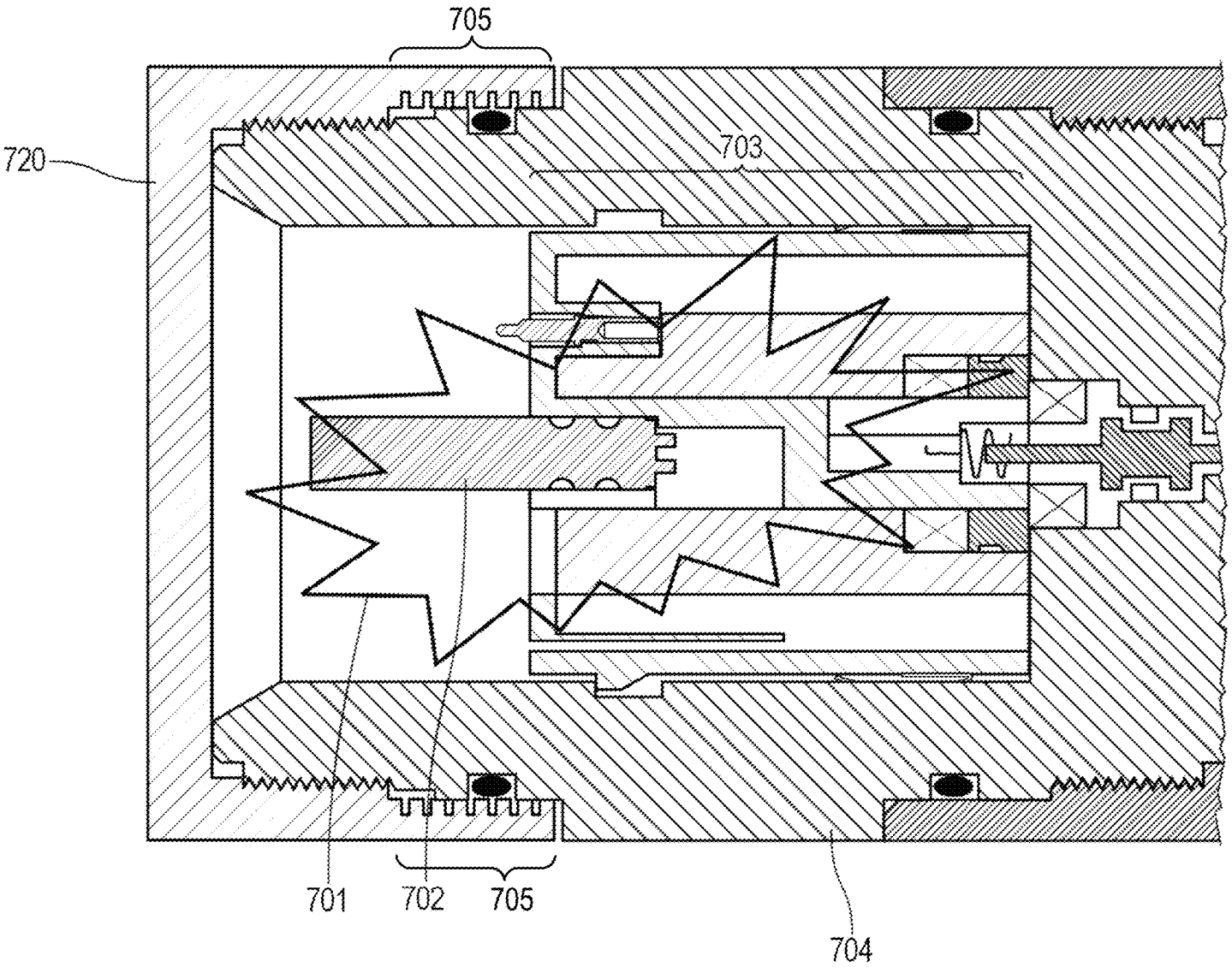
FIG. 7 is an illustration depicting an example shipping cap having deformable threads, according to some implementations.

Rather than using the vent plug 606, some implementations of the shipping cap may utilize deformable threads. FIG. 7 is an illustration depicting an example shipping cap 720 having deformable threads 705, according to some implementations. The shipping cap 720 may be threaded to an isolation cask 704 via the deformable threads 705. The isolation cask 704 may house a detonator assembly 703 having a detonator 702. In the event of an accidental detonation 701, the deformable threads 705 may be configured to deform and release excess heat and/or pressure. For example, the deformable threads 705 may be comprised of a deformable plastic, polymer, metal, metal alloy, or rubber having a desired melting point and material strength. In some implementations, the deformable threads may be comprised of a eutectic material, such as a eutectic alloy. Upon reaching a heat or pressure threshold within the isolation cask 704, the deformable threads 705 may deform and allow excess pressure/heat to escape under the shipping cap 720.

Example Operations

Figure 8:
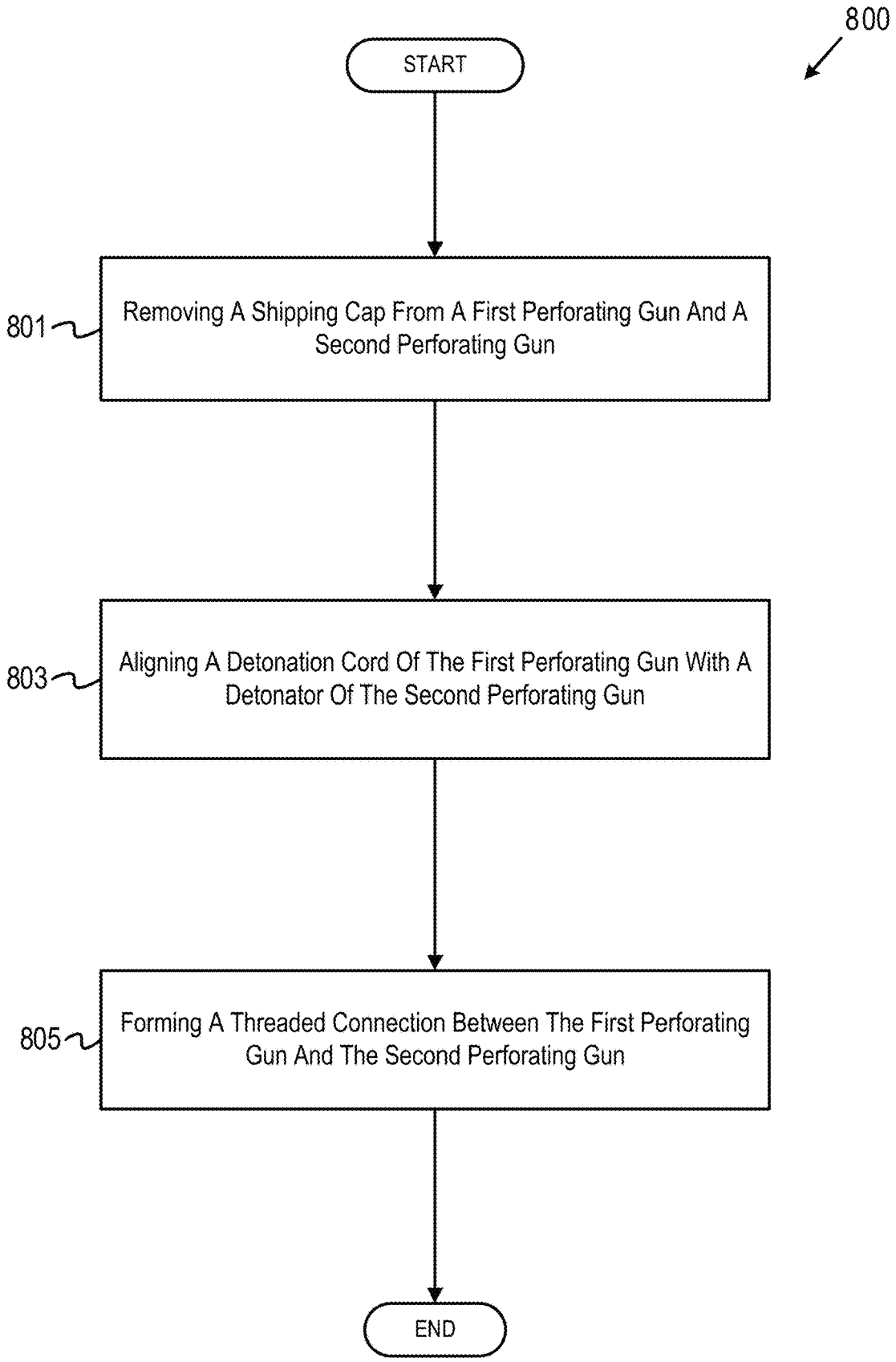
FIG. 8 is a flowchart depicting a method for ballistically arming an automated perforating gun, according to some implementations.

Example operations for arming the perforating gun 230 of FIG. 2B are now described. FIG. 8 is a flowchart depicting a method 800 for ballistically arming an automated perforating gun, according to some implementations. The method 800 may be described with reference to FIGS. 1-7. The method 800 may be performed by any combination of hardware, software, etc. In some implementations, the method 800 may be automated and performed without human intervention. Operations of the method 800 begin at block 801.

At block 801, the method 800 includes removing a shipping cap from a first perforating gun and a second perforating gun. For example, a shipping cap similar to the shipping cap 520 may be removed from the first perforating gun 210 and the second perforating gun 220. Flow progresses to block 803.

At block 803, the method 800 includes aligning a detonation cord of the first perforating gun with a detonator of the second perforating gun. For example, the detonation cord 216A of the first perforating gun 210 may be aligned with the detonator 202B of the second perforating gun 220. In some implementations, the detonation cord 216A and the detonator 202B may be aligned for side-to-side initiation. In other embodiments, the detonation cord 216A and detonator 202B may be aligned for end-to-end initiation. Flow progresses to block 805.

At block 805, the method 800 includes forming a threaded connection between the first perforating gun and the second perforating gun. For example, the first perforating gun 230 may form a threaded connection with the second perforating gun 240. The detonation cord 236A may be ballistically coupled to the detonator 222B when the threaded connection is formed, thus arming the first perforating gun 230. Flow of the method 800 ceases.

While the aspects of the disclosure are described with reference to various implementations and exploitations, it will be understood that these aspects are illustrative and that the scope of the claims is not limited to them. In general, techniques for ballistically arming a perforating gun permissible for shipping with an intact detonator as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Implementations

Implementation #1: A perforating gun configured for transport with an internal detonator, the perforating gun to be used in a wellbore proximate to one or more subsurface formations, the perforating gun comprising: a detonator assembly positioned proximate to a ballistic initiator end of the perforating gun, wherein the detonator assembly includes the detonator; a detonation cord positioned proximate to a receiver end of the perforating gun, wherein the ballistic initiator end is on an opposing side of the perforating gun from the receiver end; and an isolation cask disposed at the ballistic initiator end of the perforating gun, wherein the detonator assembly is recessed within the isolation cask.

Implementation #2: The perforating gun of Implementation 1, further comprising: a feedthrough positioned at least partially within the isolation cask, wherein the feedthrough is electrically coupled to the detonator assembly.

Implementation #3: The perforating gun of any one or more of Implementations 1-2, further comprising: a shipping cap configured to cover the isolation cask and the detonator, wherein the shipping cap isolates the detonator and the isolation cask from an outside environment.

Implementation #4: The perforating gun of any one or more of Implementations 1-3, wherein the shipping cap comprises a vent plug configured to open upon exceeding an internal pressure threshold within the isolation cask or a heat threshold.

Implementation #5: The perforating gun of any one or more of Implementations 1-4, wherein the shipping cap comprises one or more threads that are configured to form a threaded connection with an exterior of the isolation cask, wherein the threads are configured to deform upon exceeding an internal pressure threshold within the isolation cask or a heat threshold, and wherein the deformed threads allow pressure and heat to escape from the isolation cask.

Implementation #6: The perforating gun of any one or more of Implementations 1-5, wherein the isolation cask is configured to shield the detonator from radio frequencies, electromagnetic pulses, other external signals, voltages, and currents.

Implementation #7: The perforating gun of any one or more of Implementations 1-6, wherein the detonator assembly further comprises a spacer assembly including: one or more compression pads coupled to one or more springs, wherein the spacer assembly is configured to protect the detonator when forming a connection with a second perforating gun.

Implementation #8: The perforating gun of any one or more of Implementations 1-7, wherein the detonator assembly comprises a retention feature configured to slot into a groove of the isolation cask, wherein the retention feature enables quick installation and removal of the detonator assembly.

Implementation #9: A perforating gun system configured for transport with an internal detonator, the perforating gun system to be used in a wellbore proximate to one or more subsurface formations, the perforating gun system comprising: a first perforating gun comprising a detonation cord; and a second perforating gun comprising a detonator assembly having a detonator, wherein the first perforating gun is configured to couple with the second perforating gun via a threaded connection, and wherein the detonator is configured to arm upon making the threaded connection.

Implementation #10: The perforating gun system of Implementation 9, wherein the detonator assembly is recessed within an isolation cask of the second perforating gun.

Implementation #11: The perforating gun system of any one or more of Implementations 9-10, wherein the isolation cask of the second perforating gun is configured to shield the detonator from radio frequencies, electromagnetic pulses, other external signals, voltages, and currents.

Implementation #12: The perforating gun system of any one or more of Implementations 9-11, wherein the detonation cord of the first perforating gun ballistically couples to the detonation cord of the second perforating gun when forming the threaded connection.

Implementation #13: The perforating gun system of any one or more of Implementations 9-12, wherein the detonation cord of the first perforating gun is configured for side-to-side initiation with the detonator of the second perforating gun.

Implementation #14: The perforating gun system of any one or more of Implementations 9-13, further comprising: a centralizing shield coupled to an end alignment of the first perforating gun; and a spacer assembly coupled to the isolation cask of the second perforating gun, wherein the spacer assembly comprises one or more springs coupled to one or more compression pads, and wherein the one or more compression pads are configured to contact the centralizing shield.

Implementation #15: The perforating gun system of any one or more of Implementations 9-14, wherein the spacer assembly is configured to protect the detonator when forming a connection with the second perforating gun, and wherein the one or more springs are configured to account for tolerances upon forming the connection.

Implementation #16: The perforating gun system of any one or more of Implementations 9-15, further comprising: a detonation cord receptacle positioned in the first perforating gun, wherein the detonation cord receptacle is configured to allow axial rotation of the first perforating gun and the second perforating gun while maintaining a connection between the detonation cord and the detonator.

Implementation #17: A method for arming an automated perforating gun, the method comprising: removing a shipping cap from a first perforating gun and a second perforating gun; aligning a detonation cord of the first perforating gun with a detonator of the second perforating gun; and forming a threaded connection between the first perforating gun and the second perforating gun.

Implementation #18: The method of Implementation 17, wherein forming the threaded connection further comprises: coupling the detonation cord to the detonator to ballistically arm the first perforating gun.

Implementation #19: The method of any one or more of Implementations 17-18, further comprising: pressing a spacer assembly of the second perforating gun against a centralizing shield disposed on the first perforating gun, wherein pressing the spacer assembly against the centralizing shield exposes the detonator, and wherein the spacer assembly accounts for tolerances when coupling the detonation cord to the detonator.

Implementation #20: The method of any one or more of Implementations 17-19, wherein aligning the detonation cord of the first perforating gun with the detonator of the second perforating gun comprises aligning the detonation cord for side-to-side initiation with the detonator.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A perforating gun configured for transport with an internal detonator, the perforating gun to be used in a wellbore proximate to one or more subsurface formations, the perforating gun comprising:

a detonation cord;

a detonator assembly configured for transport and including the internal detonator; and an isolation cask configured to isolate the internal detonator from the detonation cord, wherein the isolation cask is configured to shield the internal detonator from at least one of radio frequencies, electromagnetic pulses, other external signals, voltages, or currents.

2. The perforating gun of claim 1, further comprising:

a feedthrough positioned at least partially within the isolation cask, wherein the feedthrough is electrically coupled to the detonator assembly, and wherein the detonator assembly is recessed within the isolation cask.

3. The perforating gun of claim 1, further comprising:

a shipping cap configured to cover the isolation cask and the internal detonator, wherein the shipping cap isolates the internal detonator and the isolation cask from an outside environment.

4. The perforating gun of claim 3, wherein the shipping cap comprises a vent plug configured to open upon exceeding an internal pressure threshold within the isolation cask or a heat threshold.

5. The perforating gun of claim 3, wherein the shipping cap comprises one or more threads that are configured to form a threaded connection with an exterior of the isolation cask, wherein the threads are configured to deform upon exceeding an internal pressure threshold within the isolation cask or a heat threshold, and wherein the deformed threads allow pressure and heat to escape from the isolation cask.

6. The perforating gun of claim 1, wherein the detonator assembly further comprises a spacer assembly including:

one or more compression pads coupled to one or more springs, wherein the spacer assembly is configured to protect the internal detonator when forming a connection with a second perforating gun, and wherein the one or more compression pads are configured to contact a centralizing shield of the second perforating gun.

7. The perforating gun of claim 1, wherein the detonator assembly comprises a threadless retention feature configured to slot into a groove of the isolation cask, wherein the threadless retention feature enables quick installation and removal of the detonator assembly.

8. A perforating gun system to be used in a wellbore proximate to one or more subsurface formations, the perforating gun system comprising:

a first perforating gun configured for transport with an internal detonator, wherein the first perforating gun includes, a first detonation cord, a detonator assembly including the detonator, and an isolation cask configured to isolate the detonator from the first detonation cord, wherein the isolation cask is configured to shield the detonator from at least one of radio frequencies, electromagnetic pulses, other external signals, voltages, or currents; and a second perforating gun configured to couple with the first perforating gun, the second perforating gun including at least a second detonation cord.

9. The perforating gun system of claim 8, wherein the second detonation cord of the second perforating gun is configured to couple with the detonator of the first perforating gun via a connection, and wherein the first second perforating gun is configured to arm upon forming the connection.

10. The perforating gun system of claim 8, wherein the second detonation cord of the second perforating gun is configured for side-to-side initiation with the detonator of the first perforating gun.

11. The perforating gun system of claim 8, further comprising:

a centralizing shield coupled to an end alignment of the second perforating gun; and a spacer assembly coupled to the isolation cask of the first perforating gun, wherein the spacer assembly comprises one or more springs coupled to one or more compression pads, and wherein the one or more compression pads are configured to contact the centralizing shield.

12. The perforating gun system of claim 11, wherein the spacer assembly is configured to protect the detonator when forming a connection between the first perforating gun and the second perforating gun, and wherein the one or more springs are configured to account for tolerances upon forming the connection.

13. The perforating gun system of claim 8, further comprising:

a detonation cord receptacle positioned in the second perforating gun, wherein the detonation cord receptacle is configured to allow axial rotation of the first perforating gun and the second perforating gun while maintaining a connection between the second detonation cord and the detonator.

14. The perforating gun system of claim 8, wherein the detonator assembly of the first perforating gun comprises a threadless retention feature configured to slot into a groove of the isolation cask, wherein the threadless retention feature enables quick installation and removal of the detonator assembly.

15. A method comprising:

configuring at least a first perforating gun for transport with a pre-installed detonator, wherein the first perforating gun includes the detonator and an isolation cask configured to surround the detonator, and wherein the isolation cask is configured to shield the detonator from at least one of radio frequencies, electromagnetic pulses, other external signals, voltages, or currents; and coupling the detonator of the first perforating gun with a detonation cord of a second perforating gun.

16. The method of claim 15, further comprising:

removing a shipping cap from the first perforating gun and the second perforating gun; and forming a threaded connection between the first perforating gun and the second perforating gun, wherein coupling the detonation cord to the detonator ballistically arms the first second perforating gun.

17. The method of claim 15, further comprising:

pressing a spacer assembly of the first perforating gun against a centralizing shield disposed on the second perforating gun, wherein pressing the spacer assembly against the centralizing shield exposes the detonator, and wherein the spacer assembly accounts for tolerances when coupling the detonation cord to the detonator.

18. The method of claim 15, wherein coupling the detonation cord of the second perforating gun with the detonator of the first perforating gun comprises aligning the detonation cord for side-to-side initiation with the detonator.

* * * * *